US010124580B2

(12) United States Patent
Hirano et al.

(10) Patent No.: US 10,124,580 B2
(45) Date of Patent: Nov. 13, 2018

(54) TABLET PRINTING APPARATUS AND TABLET PRINTING METHOD

(71) Applicant: SHIBAURA MECHATRONICS CORPORATION, Yokohama (JP)

(72) Inventors: Azusa Hirano, Yokohama (JP); Yasutsugu Tsuruoka, Yokohama (JP); Junsuke Komito, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 15/740,465

(22) PCT Filed: May 30, 2016

(86) PCT No.: PCT/JP2016/065893

§ 371 (c)(1),
(2) Date: Dec. 28, 2017

(87) PCT Pub. No.: WO2017/002502

PCT Pub. Date: Jan. 5, 2017

(65) Prior Publication Data

US 2018/0194132 A1 Jul. 12, 2018

(30) Foreign Application Priority Data

Jun. 30, 2015 (JP) ..... 2015-131796

(51) Int. Cl.
*B41J 2/045* (2006.01)
*B41J 2/145* (2006.01)
(Continued)

(52) U.S. Cl.
CPC ..... *B41J 2/04526* (2013.01); *B41J 2/04581* (2013.01); *B41J 2/145* (2013.01);
(Continued)

(58) Field of Classification Search
CPC ..... B41J 2/04526; B41J 2/04581; B41J 2/04508; B41J 2/145; B41J 2/125;
(Continued)

(56) References Cited

U.S. PATENT DOCUMENTS

2014/0168309 A1 6/2014 Morita
2017/0297351 A1* 10/2017 Fujioka ..... B41J 3/28

FOREIGN PATENT DOCUMENTS

JP H6-143539 A 5/1994
JP 2011-125835 A 6/2011
(Continued)

OTHER PUBLICATIONS

International Search Report for International Application No. PCT/JP2016/065893 dated Aug. 16, 2016.

*Primary Examiner* — Thinh H Nguyen
(74) *Attorney, Agent, or Firm* — Kratz, Quintos & Hanson, LLP

(57) ABSTRACT

[Problem to be Solved] To provide a tablet printing apparatus and a tablet printing method that can perform printing with high quality by ejecting ink droplets to a tablet with a various posture from a plurality of nozzles.

[Solution] A tablet printing apparatus includes: inclined posture detector (23, 100) that detects an inclined posture of a conveyed tablet with respect to a conveying surface; a printer including an inkjet head 21 equipped with a plurality of nozzles for ejecting an ink droplet, the printer performing printing on the conveyed tablet by ejecting ink to the conveyed tablet from the plurality of nozzles; and a controller 100 for adjusting preset printing data corresponding to an inclined posture of the tablet detected by the inclined posture detector such that predetermined printing is per-
(Continued)

formed on the tablet, wherein the printer performs printing on the tablet based on printing data adjusted by the printing data adjuster.

9 Claims, 16 Drawing Sheets

(51) Int. Cl.

| | |
|---|---|
| ***B41J 3/407*** | (2006.01) |
| ***B41M 5/00*** | (2006.01) |
| *B41J 2/125* | (2006.01) |
| *B41J 2/14* | (2006.01) |

(52) U.S. Cl.
CPC ..... *B41J 3/4073* (2013.01); *B41M 5/0088* (2013.01); *B41J 2/125* (2013.01); *B41J 2/14153* (2013.01)

(58) Field of Classification Search
CPC ..... B41J 2/13; B41J 2/14153; B41J 3/4073; B41M 5/0088
See application file for complete search history.

(56) References Cited

FOREIGN PATENT DOCUMENTS

| | | | |
|---|---|---|---|
| JP | 2013-13711 | A | 1/2013 |
| WO | 2012169391 | A2 | 12/2012 |

* cited by examiner

TABLET PRINTING APPARATUS AND TABLET PRINTING METHOD

TECHNICAL FIELD

The present invention relates to a tablet printing apparatus which performs printing of characters, marks, pictures and the like on a surface of a tablet conveyed by a conveyor belt.

BACKGROUND ART

Conventionally, a solid preparation printing apparatus (tablet printing apparatus) described in Patent Literature 1 has been known. The solid preparation printing apparatus includes a printer, which performs printing (transfer) by a transfer roller, and the printer performs printing of characters, marks and the like on surfaces of solid preparations (tablets) sequentially conveyed by a conveyor (conveyor belt). In the conveyor, pockets having a minute hole are arranged in the conveying direction of the conveyor. With the movement of the conveyor with solid preparations accommodated in the pockets of the conveyor, the solid preparations are sequentially conveyed. An air suction part, which sucks air through the minute hole formed in each pocket, is disposed on the back side of a portion of the conveyor which opposedly faces the transfer roller. By an air suction effect of the air suction part, the solid preparation accommodated in each pocket is fixed in the pocket at the portion of the conveyor opposedly facing the transfer roller. By fixing the solid preparation as described above, the transfer roller can transfer (print) characters, marks and the like on the solid preparation accommodated in each pocket without misalignment. Then, an ink transferred to surfaces of respective solid preparations is dried by a hot air dryer disposed on the downstream side of the printer in the conveying direction along which solid preparations are conveyed.

By taking into account ease of changing characters or marks, and hygiene, an ink ejection printer (so-called inkjet printer), which performs printing in a non-contact manner, may be used in place of a printer using the transfer roller. The inkjet printer includes an inkjet head equipped with a plurality of nozzles for ejecting ink droplets. The inkjet printer ejects ink droplets from the plurality of nozzles of the inkjet head in accordance with a pattern based on printing data thus performing printing on a surface of a tablet.

CITATION LIST

Patent Literature

Patent Literature 1: Japanese Patent Laid-Open No. H6-143539

SUMMARY OF INVENTION

Technical Problem

As in the case of the above-mentioned conventional solid preparation printing apparatus, in feeding tablets onto a conveyor belt, the tablets may be fed onto a surface of the conveyor belt by dropping the tablets from above the conveyor belt.

When a tablet is fed onto a conveyance system by dropping as described above, it is quite difficult to fix the posture of the tablet. For example, the tablet may be held in a pocket or by a suction system in an inclined state. When printing is performed on a tablet with such an inclined posture by an inkjet printer, which performs printing in a non-contact manner, printed characters, marks or pictures may be displaced from a desired position.

The present invention has been made in view of such circumstances, and it is an object of the present invention to provide a tablet printing apparatus and a tablet printing method that can perform printing with high quality by ejecting ink droplets from a plurality of nozzles to a tablet with an inclined posture.

Solution to Problem

A tablet printing apparatus according to the present invention includes: an inclined posture detector that detects an inclined posture of a conveyed tablet with respect to a conveying surface; a printer including an inkjet head equipped with a plurality of nozzles for ejecting an ink droplet, the printer performing printing on the conveyed tablet by ejecting ink to the conveyed tablet from the plurality of nozzles; and a printing data adjuster that adjusts preset printing data in accordance with the inclined posture of the tablet detected by the inclined posture detector such that predetermined printing is performed on the tablet, wherein the printer performs printing on the tablet based on printing data adjusted by the printing data adjuster.

A tablet printing method according to the present invention includes: an inclined posture detecting step of detecting an inclined posture of a conveyed tablet with respect to a conveying surface; a printing step of performing printing on the tablet by ejecting ink to the conveyed tablet from a plurality of nozzles of an inkjet head; and a printing data adjusting step of adjusting preset printing data in accordance with the inclined posture of the tablet detected in the inclined posture detecting step such that predetermined printing is performed on the table, wherein in the printing step, printing is performed based on printing data adjusted in the printing data adjusting step.

With such a configuration, an inclined posture of a conveyed tablet with respect to the conveying surface is detected, printing data is adjusted in accordance with the inclined posture of the tablet such that predetermined printing is performed on the tablet, and printing is performed on the tablet in accordance with the adjusted printing data by ejecting ink from the plurality of nozzles.

Advantageous Effect of Invention

According to the tablet printing apparatus and the tablet printing method of the present invention, printing data is adjusted in accordance with the inclined posture of a conveyed tablet such that predetermined printing is performed on the tablet, and printing is performed on the tablet in accordance with the adjusted printing data by ejecting ink from the plurality of nozzles, so printing can be performed with high quality by ejecting ink droplets to the tablet with a various posture from the plurality of nozzles.

DESCRIPTION OF EMBODIMENT

Hereinafter, an embodiment of the present invention will be described with reference to the drawings.

A tablet which is a print target of a tablet printing apparatus according to the present invention is described by taking, as one example, a tablet Tb which has a perfect circular shape as viewed in a plan view, and has curved surfaces. However, the tablet may include pills and tablets such as a non-coated tablet (uncoated tablet), a sugar-coated tablet, a film-coated tablet (FC tablet), an enteric coated tablet, a gelatin-coated tablet, a multilayered tablet, and a dry coated tablet, and may also include capsules such as a hard capsule and a soft capsule. A tablet may be used for any purpose such as medicine, food, detergent, and industrial use.

Figure 1:
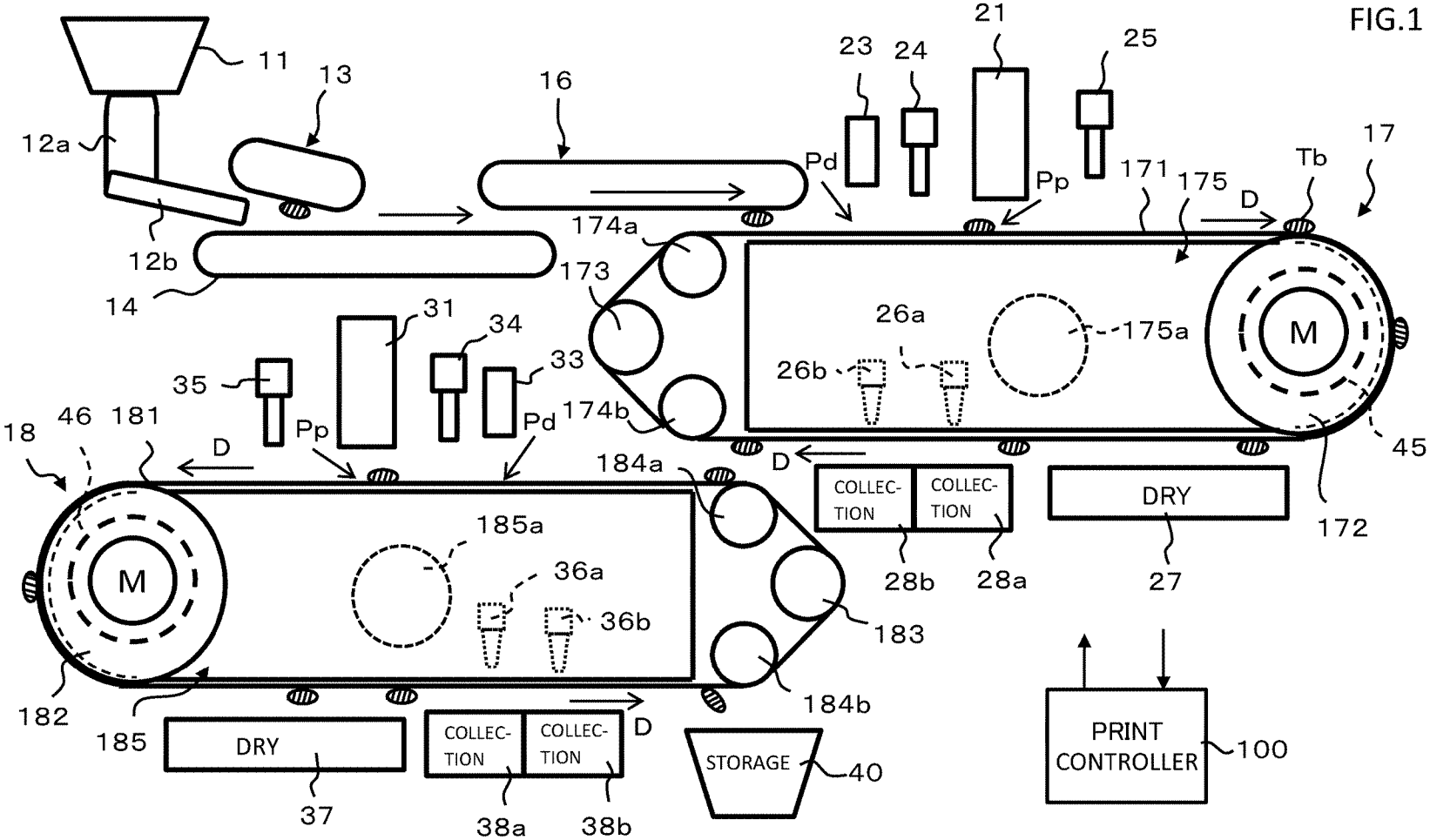
FIG. 1 is a diagram schematically showing an overall configuration of a tablet printing apparatus according to an embodiment of the present invention.

The tablet printing apparatus according to one embodiment of the present invention is configured as shown in FIG. 1. In FIG. 1, a hopper 11 which stores tablets as print targets, a first vibrating feeder 12*a*, and a second vibrating feeder 12*b* are disposed consecutively. A first transfer feeder 13 and an alignment feeder 14 are further consecutively disposed following the second vibrating feeder 12*b*. A first conveyor 17 is disposed downstream of the alignment feeder 14. A second transfer feeder 16 is disposed so as to overlap with a rear end portion of the alignment feeder 14 and a front end portion of the first conveyor 17 from above.

Each of the first vibrating feeder 12*a* and the second vibrating feeder 12*b* has a structure where a vibrator is provided to a trough-like conveyor path, for example. Tablets Tb sequentially fed from the hopper 11 are sequentially moved toward the alignment feeder 14 through the conveyor path by the vibration. The alignment feeder 14 has a structure where an alignment guide is disposed on a conveyor path. The alignment feeder 14 divides the tablets Tb into two rows, for example, using the alignment guide, and sequentially conveys the tablets Tb in the respective rows toward the second transfer feeder 16. Each of the first transfer feeder 13 and the second transfer feeder 16 has a structure where a gas permeable conveyor belt is wound around two pulleys not shown in the drawing, and a suction chamber, to which a suction device not shown in the drawing is connected, is formed inside the conveyor belt. In the first transfer feeder 13, the conveyor belt conveys the tablets Tb from the first vibrating feeder 12*b* while receiving the tablets Tb by the suction effect of the suction chamber, and transfers the tablets Tb to the alignment feeder 14 at a position where the suction effect of the suction chamber no longer acts. In the second transfer feeder 16, the conveyor belt conveys the tablets Tb from the alignment feeder 14 while sucking the tablets Tb by the suction effect of the suction chamber, and transfers the tablets Tb to the first conveyor 17 at a position where the suction effect of the suction chamber no longer acts.

Figure 2:
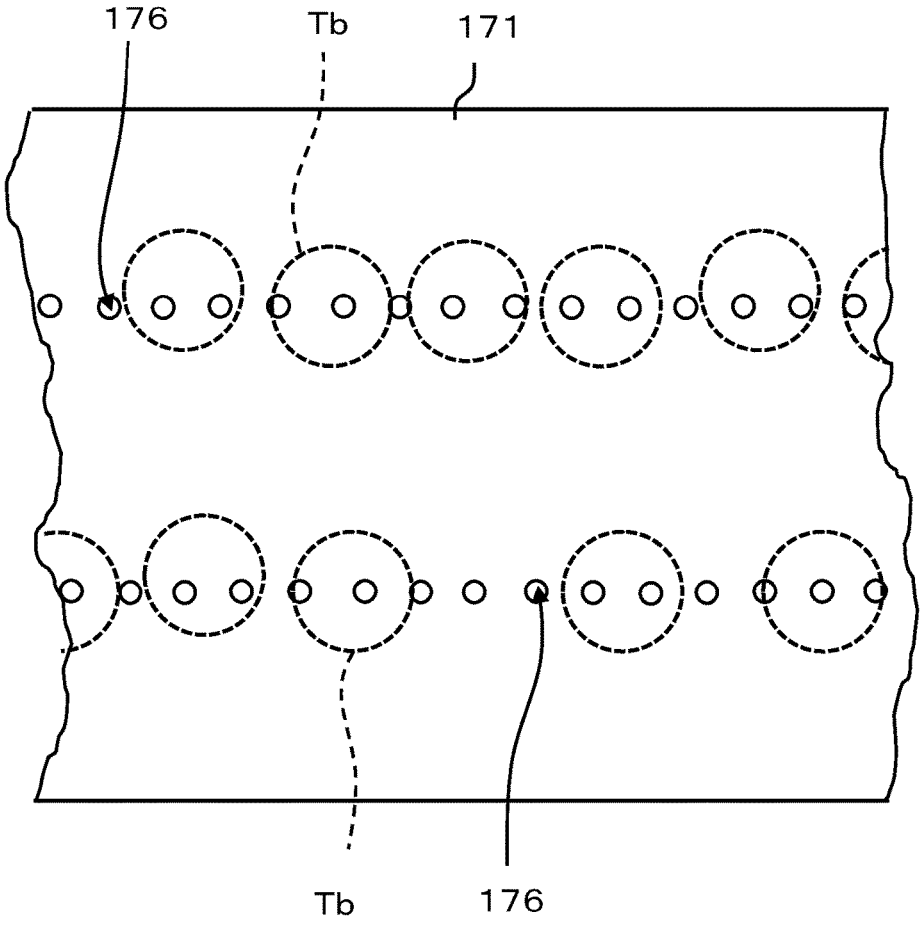
FIG. 2 is a plan view showing tablets conveyed by a conveyor belt used in the tablet printing apparatus shown in FIG. 1.

The first conveyor 17 has a structure where a conveyor belt 171 is wound around a drive pulley 172, a tension pulley 173, and two adjustment pulleys 174*a*, 174*b*. As shown in FIG. 2, through holes 176 are formed in the conveyor belt 171 so as to be arranged at predetermined intervals in the moving direction of the conveyor belt 171. The through holes 176 are formed in two rows so as to correspond to the respective rows of the tablets Tb which are fed onto the conveyor belt 171 in a state of being arranged in two rows by the alignment feeder 14. Suction air is made to pass through the respective through holes 176 thus causing the tablets Tb to be adhered to the conveyor belt 171. The drive pulley 172 is driven by a motor M. Due to the rotation of the drive pulley 172 caused by driving the motor M, the annular conveyor belt 171 rotationally moves. Further, a first encoder 45 which operates together with the rotation of a drive shaft of the motor M is provided on the drive pulley 172 side. A suction chamber 175 is formed inside the annular conveyor belt 171, and a suction device (for example, vacuum pump) not shown in the drawing is connected to the suction chamber 175. Air is sucked from a rear surface side of the conveyor belt 171 by the suction effect of the suction chamber 175. With such suction of air, tablets Tb are held by suction on a surface of the conveyor belt 171 through the through holes 176.

The tablet printing apparatus uses an inkjet printer. The inkjet printer includes an inkjet head equipped with a plurality of nozzles for ejecting ink droplets, and causes energy generating elements, such as piezoelectric elements and thermal elements, to be driven in accordance with printing data thus ejecting ink droplets from the respective nozzles so as to perform printing. An inkjet head (referred to as "first inkjet head") 21 of the inkjet printer, a first tablet posture sensor unit 23 formed of two laser displacement sensors 23*a*, 23*b* (see FIG. 3A to FIG. 3C), a first posture check camera 24, a first print check camera 25, a first dryer 27, and two collection trays 28*a*, 28*b* are disposed around the conveyor belt 171. In the suction chamber 175, two air injection nozzles 26*a*, 26*b* are disposed so as to opposedly face the collection trays 28*a*, 28*b* with the conveyor belt 171 interposed between the air injection nozzles 26*a*, 26*b* and the collection trays 28*a*, 28*b*.

As described previously, tablets Tb arranged in two rows by the alignment feeder 14 are fed onto the conveyor belt 171 of the first conveyor 17 by way of the second transfer feeder 16. In this case, in an actual apparatus, to perform printing on the respective tablets Tb in two rows on the conveyor belt 171, two sets of components are provided so as to correspond to the tablets Tb in two rows. Each set of components is formed of the above-mentioned first inkjet head 21, first tablet posture sensor unit 23, first posture check camera 24, first print check camera 25, two air injection nozzles 26*a*, 26*b*, first dryer 27, and two collection trays 28*a*, 28*b*. These two sets of components perform the same operation and hence, hereinafter, the description is made with respect to one set.

The first inkjet head 21 (a plurality of nozzles) is disposed so as to opposedly face the surface of the conveyor belt 171 at a print position Pp. The first tablet posture sensor unit 23 outputs a detection signal based on an inclined posture of a tablet Tb with respect to the surface of the conveyor belt 171 at a tablet detection position Pd, which is set at a predetermined position on the upstream side of the print position Pp in the moving direction D of the conveyor belt 171 (the conveying direction D along which tablets Tb are conveyed). Further, a detection signal from the first tablet posture sensor unit 23 can be used as a signal indicating presence or absence of a tablet Tb on the conveyor belt 171 at the tablet detection position Pd. A shooting region of the first posture check camera 24 includes a predetermined area defined between the above-mentioned print position Pp and tablet detection position Pd on the conveyor belt 171. A shooting region of the first print check camera 25 is set to a predetermined area on the downstream side of the print position Pp in the moving direction D of the conveyor belt 171 (the conveying direction D along which tablets Tb are conveyed). The two air injection nozzles 26*a*, 26*b* and the two collection trays 28*a*, 28*b* are disposed on the lower side of the suction chamber 175 so as to sandwich the conveyor belt 171 made to extend between the drive pulley 172 and the adjustment pulley 174*b*. Further, at a predetermined position on the upstream side of the collection trays 28*a*, 28*b*, the first dryer 27 is disposed so as to opposedly face the conveyor belt 171.

Figure 3A:
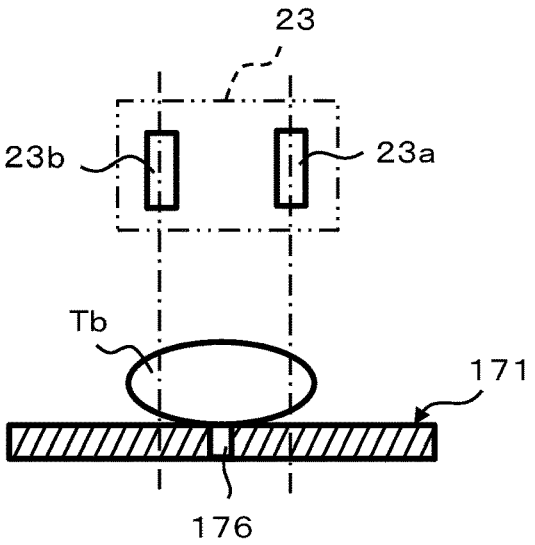
FIG. 3A is a view showing a state of a tablet on the conveyor belt and a first tablet posture sensor unit as viewed in the conveying direction.
Figure 3B:
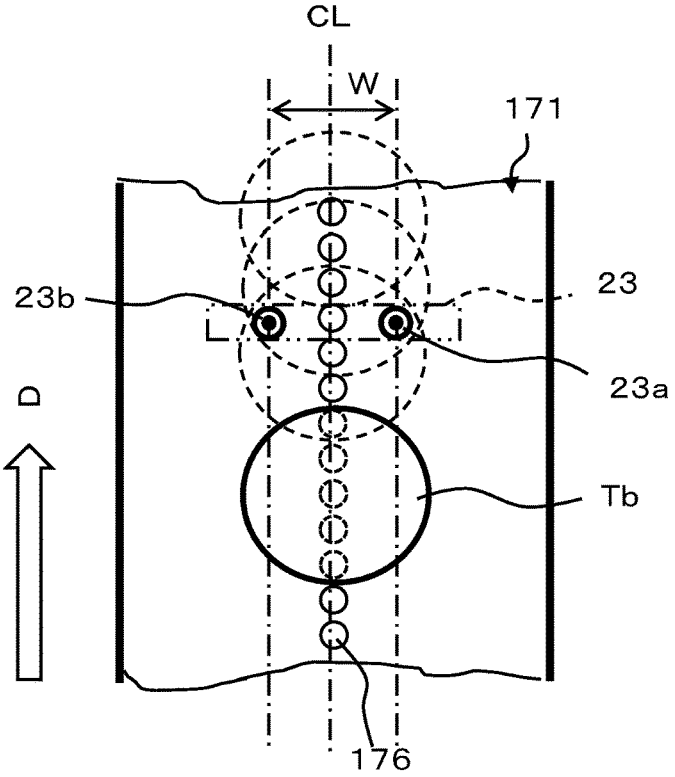
FIG. 3B is a plan view showing the positional relationship between the tablet on the conveyor belt and the first tablet posture sensor unit.
Figure 3C:
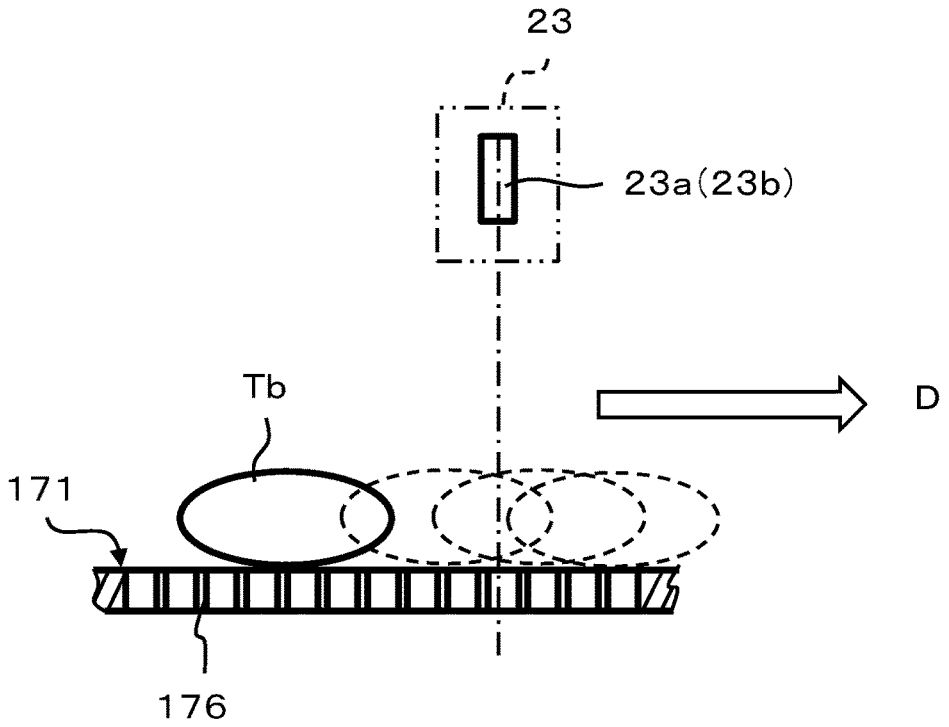
FIG. 3C is a view showing a state of the tablet on the conveyor belt and the first tablet posture sensor unit as viewed in the direction orthogonal to the conveying direction.

As shown in FIG. 3A to FIG. 3C, the first tablet posture sensor unit 23 described above is disposed so as to opposedly face the conveyor belt 171. FIG. 3A is a view showing a state of a tablet Tb on the conveyor belt and the first tablet posture sensor unit 23 as viewed in the conveying direction. FIG. 3B is a plan view showing the positional relationship between the tablet Tb on the conveyor belt and the first tablet posture sensor unit 23. FIG. 3C is a view showing a state of the tablet Tb on the conveyor belt and the first tablet posture sensor unit 23 as viewed in the direction orthogonal to the conveying direction.

In FIG. 3A to FIG. 3C, the first tablet posture sensor unit 23 includes two laser displacement sensors (optical displacement sensors) consisting of a right laser displacement sensor 23*a* and a left displacement laser sensor 23*b*. These two laser displacement sensors 23*a*, 23*b* are disposed so as to be arranged in a row in the direction (the direction crossing the conveying direction D) orthogonal to the conveying direction D along which tablets Tb are conveyed. Further, the laser displacement sensors 23*a*, 23*b* are symmetrically disposed with respect to a line CL where center positions of respective tablets Tb to be conveyed are expected to travel, to be more specific, the line CL along which the through holes 176 formed in the conveyor belt 171 are arranged (see FIG. 3B). A distance W between the two laser displacement sensors 23*a*, 23*b* is set to a predetermined value slightly smaller than a diameter of a tablet Tb. Each of the right laser displacement sensor 23*a* and the left laser displacement sensor 23*b* outputs a detection signal of the level which corresponds to a distance from a surface of an object on which an emitted laser beam is reflected (for example, a distance from a surface of a tablet Tb on which an emitted laser beam is reflected).

Returning to FIG. 1, the second conveyor 18 has a structure substantially equal to the structure of the first conveyor 17 described above. To be more specific, the second conveyor 18 has the structure where a conveyor belt 181 is wound around a drive pulley 182 driven by a motor M equipped with a second encoder 46, a tension pulley 183, and two adjustment pulleys 184*a*, 184*b*. A suction chamber 185 is formed inside the conveyor belt 181. The suction chamber 185 is connected to a suction device not shown in the drawing through a discharge port 185*a*. In the same manner as the conveyor belt 171, through holes are formed also in the conveyor belt 181 at predetermined intervals in the moving direction of the conveyor belt 181. By the suction effect of the suction chamber 185, tablets Tb are held by suction on the conveyor belt 181 through the through holes. A second inkjet head 31 of the inkjet printer (print position Pp), a second tablet posture sensor unit 33 (tablet detection position Pd), a second posture check camera 34, a second print check camera 35, a second dryer 37, and two collection trays 38*a*, 38*b* are disposed around the conveyor belt 181. Further, in the suction chamber 185, two air injection nozzles 36*a*, 36*b* are disposed so as to opposedly face the two collection trays 38*a*, 38*b* with the conveyor belt 181 interposed therebetween. Particularly, in the second conveyor 18, a storage tray 40 is disposed so as to opposedly face a furthermost downstream portion in the moving direction D of the conveyor belt 181 (the conveying direction D along which tablets Tb are conveyed).

In the tablet printing apparatus having the above-mentioned structure, characters or marks are sequentially printed on surfaces of tablets Tb as follows under control of a print controller 100.

Tablets Tb are sequentially fed from the hopper 11, and move through the first vibrating feeder 12*a* and the second vibrating feeder 12*b*. Then, the tablets Tb are transferred to the alignment feeder 14 by the first transfer feeder 13. The tablets Tb are arranged in two rows, for example, by the alignment feeder 14, and are sequentially transferred to the first conveyor 17 by the second transfer feeder 16. The tablets Tb sequentially transferred to the first conveyor 17 by the second transfer feeder 16 are sequentially conveyed in a state where the tablets Tb are held by suction on the conveyor belt 171 in two rows (see FIG. 2).

In the first conveyor 17, a tablet Tb (positioned at the tablet detection position Pd) is detected on the basis of detection signals from the first tablet posture sensor unit 23 (the laser displacement sensors 23*a*, 23*b*) while tablets Tb in the respective rows are being conveyed. After this, positions of the detected tablet Tb, where the tablet detection position Pd is a starting point, is identified on the basis of values of the first encoder 45 by a print controller 100. For example, based on the detection result from either of the laser displacement sensors 23*a*, 23*b* which detects the tablet Tb before the other, the print controller 100 identifies the position of the tablet Tb. When the tablet Tb passes through an area below the first tablet posture sensor unit 23, the print controller 100 also generates inclined posture information indicating an inclined posture of the tablet Tb based on detection signals respectively outputted from the right laser displacement sensor 23*a* and the left laser displacement sensor 23*b* of the first tablet posture sensor unit 23 (inclined posture information generator). The inclined posture of the tablet Tb means an inclination of the tablet Tb with respect to the surface of the conveyor belt 171. Detection signals outputted from the right laser displacement sensor 23*a* and the left laser displacement sensor 23*b* vary in accordance with the inclined posture of the tablet Tb. These right laser displacement sensor 23*a* and left laser displacement sensor 23*b* (optical displacement sensors) and the print controller 100 having a function of generating the inclined posture information form inclined posture detector. The description of the generation of inclined posture information is made later in detail.

When a tablet Tb enters the shooting region of the first posture check camera 24, the first posture check camera 24 takes a picture of a predetermined photographing area. The print controller 100 determines presence or absence of stains or damage such as chipping on the tablet Tb based on an image obtained by taking a picture of the photographing area using the first posture check camera 24. Further, the print controller 100 generates plane posture information indicating a planar posture of the tablet Tb determined to have no damage on the conveyor belt 171 (the planar posture including a posture such as the front or back side of the tablet Tb, the position of the tablet Tb on the conveyor belt 171, and the direction of the tablet Tb held on the belt). The print controller 100 adjusts printing data, which corresponds to a tablet Tb in a reference posture, based on the plane posture information and inclined posture information such that predetermined printing is performed on the tablet Tb in an actual plane posture and an actual inclined posture (printing data adjuster). In this embodiment, the reference posture of a tablet Tb means a posture where, for example, the printing direction of characters or marks to be printed on the tablet Tb extends in the direction orthogonal to the conveying direction, the center position of the tablet Tb aligns with the line CL along which the through holes 176 are arranged in a row, and the tablet Tb is not inclined with respect to the surface of the conveyor belt 171. Print data which corresponds to the reference posture is preset. The adjustment of the printing data is performed by adjusting predetermined printing data such that printing equal to printing performed on a tablet Tb in a reference posture, which is a predetermined posture, is performed on a tablet Tb in an actual plane posture and an actual inclined posture.

Figure 4A:
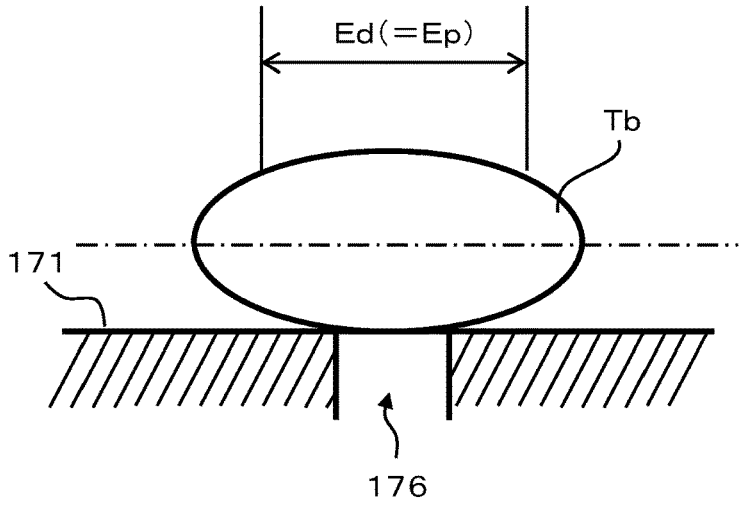
FIG. 4A is a view showing the relationship between a printing area Ep and an ink droplet ejection area Edc on a tablet with a reference posture on the conveyor belt.
Figure 4B:
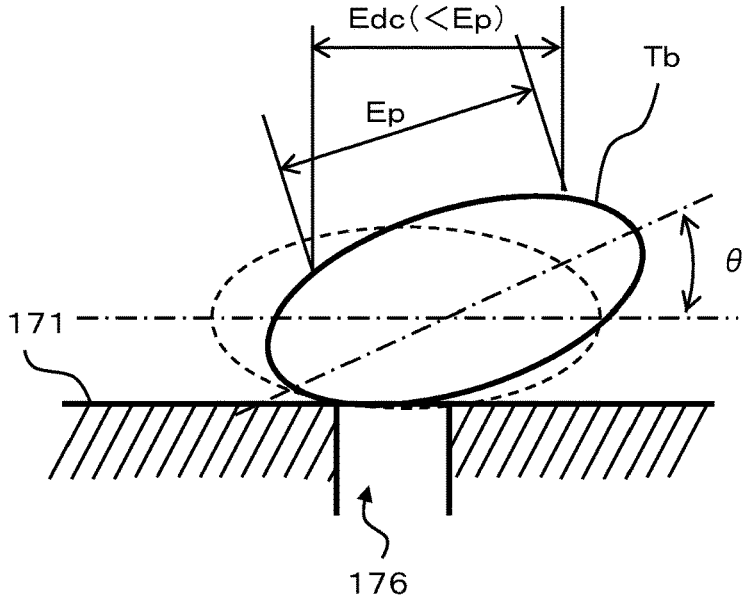
FIG. 4B is a view showing the relationship between a printing area Ep and an ink droplet ejection area Edc on a tablet with an inclined posture on the conveyor belt.

For example, as shown in FIG. 4A, when printing is performed on a tablet Tb in the reference posture, a printing area Ep on the tablet Tb and an ink droplet ejection area Ed in printing data correspond to each other (Ed=Ep). On the other hand, for example, as shown in FIG. 4B, when printing is performed on a tablet Tb in a posture inclined by an angle θ with respect to the surface of the conveyor belt 171, to perform regular printing in a printing area Ep on the inclined tablet Tb, printing data is adjusted such that an ink droplet ejection area Edc becomes narrower than the printing area Ep (Edc<Ep).

A distance between the inkjet head 21 and a printing surface also varies depending on the inclination of a tablet Tb. To cope with such variation in distance, conditions for ejecting ink droplets are adjusted. For example, when the tablet Tb is inclined with respect to the reference posture, printing data is adjusted such that the ejection amount of ink droplet to a portion of a tablet Tb close to the inkjet head 21 is reduced, while the ejection amount of ink droplet to a portion of the tablet Tb where a distance from the inkjet head 21 is increased by the inclination of the tablet Tb is increased. By performing such adjustments, the printing data is adjusted such that a small amount of ink droplet is deposited onto a position close to the inkjet head 21, while a large amount of ink droplet is deposited onto a position where a distance from the inkjet head 21 is increased by the inclination of the tablet Tb. Accordingly, a normal printing state of the whole tablet Tb can be achieved. This is because even when a distance between the inkjet head 21 and the printing surface is increased, an ejection amount of ink droplet is increased so as to increase a weight of the ink droplet whereby it is possible to cause the ink droplet to be deposited onto a scheduled depositing position with certainty. The adjustment of the ejection amount is performed by the adjustment of a driving amount of an energy generating element such as a piezoelectric element and a thermal element. For example, a voltage to be applied to the piezoelectric element is adjusted. With respect to the adjustment of the ejection amount, it is not always necessary to adjust an ejection amount of ink droplet to a portion of a tablet Tb close to the inkjet head 21, and it may be possible to adjust only an ejection amount of ink droplet to a portion where a distance from the inkjet head 21 is increased by the inclination of the tablet Tb.

A dot pitch of ink droplets which are ejected from the plurality of nozzles of the inkjet head 21 and deposited onto a printing surface also varies depending on an inclined state of a tablet. For example, a dot pitch of ink droplets deposited onto a plane is substantially equal to an interval of the nozzles. However, a dot pitch of ink droplets deposited onto an inclined surface is larger than the interval of the nozzles when viewed from the direction of the inclined surface. Accordingly, nozzles for ejecting ink droplets are selected by taking into account such points so that a dot pitch of ink droplets to be deposited onto a tablet is adjusted. With such an adjustment, even when printing is performed on an inclined tablet, when viewing the tablet in a non-inclined state, it is possible to bring about a printing state substantially equal to a printing state obtained by performing printing on a tablet in a non-inclined state.

When the tablet Tb determined to have no damage passes through the print position Pp, the print controller 100 controls an ejection pattern of ink droplets ejected from the plurality of nozzles of the first inkjet head 21 (selection of nozzles for ejecting ink, an ink ejection amount and the like) in accordance with printing data adjusted as described above. As a result, when the tablet Tb passes through the print position Pp, characters, marks or the like are printed on a predetermined position of the surface of the tablet Tb with a predetermined direction.

Further, when the tablet Tb on which the printing has been performed (the tablet Tb which passes through the print position Pp) enters the shooting region of the first print check camera 25, the first print check camera 25 takes a picture of a predetermined photographing area. The print controller 100 determines whether or not the characters or the marks are normally printed on the tablet Tb based on an image obtained by taking a picture of the photographing area using the first print check camera 25. Then, the print controller 100 thereafter tracks the positions (based on values from the first encoder 45) of the tablet Tb which is determined that printing is not normally performed.

The printed tablet Tb which has passed through the shooting region of the first print check camera 25 is conveyed along with the movement of the conveyor belt 171. When the tablet Tb is conveyed while opposedly facing the first dryer 27, ink of the characters or the marks printed on the surface of the tablet Tb is dried (fixed). Assume a tablet Tb where the tablet Tb has damage such as chipping so that printing is not performed on the tablet Tb so that the position of the tablet Tb is tracked by the print controller 100. When such a tablet Tb arrives at a position which opposedly faces one air injection nozzle 26*a*, the tablet Tb is blown off the conveyor belt 171 by air injected from the air injection nozzle 26*a* thus being collected into the collection tray 28*a*. Assume a tablet Tb where the tablet Tb has no damage such as chipping, but printing is not normally performed on the tablet Tb so that the position of the tablet Tb is tracked by the print controller 100. When such a tablet Tb arrives at a position which opposedly faces the other air injection nozzle 26*b*, the tablet Tb is blown off the conveyor belt 171 by air injected from the air injection nozzle 26*b* thus being collected into the other collection tray 28*b*.

A tablet Tb where characters or marks are normally printed on a surface of the tablet Tb is conveyed along with the movement of the conveyor belt 171, and drops onto the conveyor belt 181 of the second conveyor 18 from the conveyor belt 171 at a position where the suction effect of the suction chamber 175 no longer acts. In such a manner, the tablet Tb where printing is normally performed on the surface of the tablet Tb is transferred from the first conveyor 17 to the second conveyor 18. That is, the tablet Tb is transferred in an upside down state where a surface of the tablet Tb on which printing has been performed is disposed on the conveyor belt 181 side.

Also in the second conveyor 18, in the same manner as the first conveyor 17, with respect to tablets Tb sequentially conveyed along with the movement of the conveyor belt 181, the print controller 100 performs a control of: position tracking based on a value from the second encoder 46 which uses a timing, at which a detection signal is outputted from the second tablet posture sensor unit 33 (tablet detection position Pd), as a starting point; generation of inclined posture information and plane posture information; adjustment of printing data based on the inclined posture information and the plane posture information; printing of characters, marks or the like on a rear surface (a surface on a side opposite to a surface on which printing has been performed in the first conveyor 17) of each tablet Tb by the second inkjet head 31 (positioned at the print position Pp) based on the adjusted printing data; drying of ink of the characters or the marks printed on the tablet Tb by the second dryer 37; collection of a tablet Tb having damage into the collection tray 38*a* by the air injection nozzle 36*a*; and collection of a tablet Tb having a printing defect into the collection tray 38*b* by the air injection nozzle 36*b*. Tablets Tb where printing has been normally performed drop and are accommodated into the storage tray 40 at a position where the suction effect of the suction chamber 185 no longer acts.

The principle of the generation of the above-mentioned inclined posture information is described.

Figure 5:
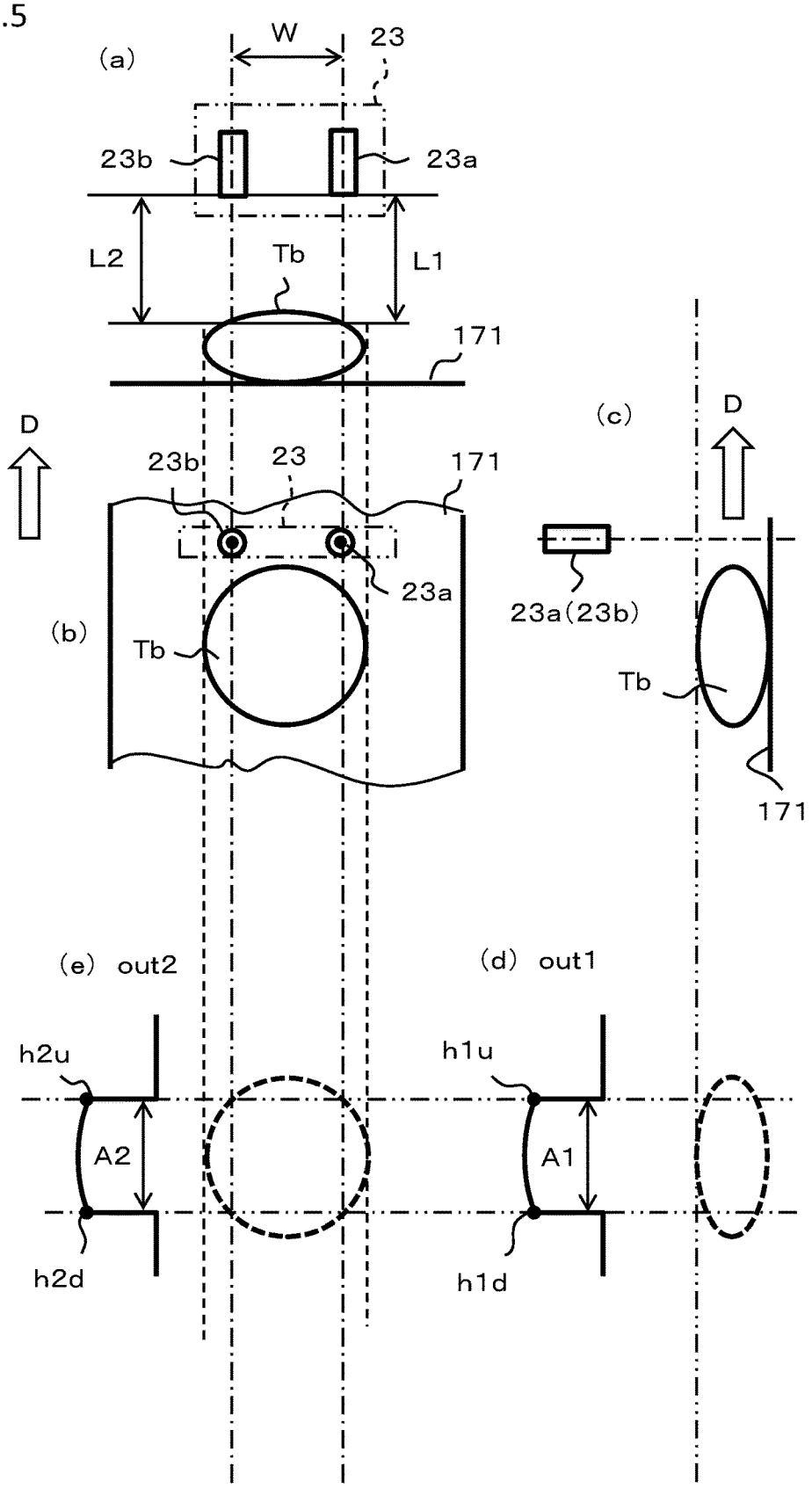
FIG. 5 is a view showing one example of the relationship between a right laser displacement sensor and a left laser displacement sensor, and a tablet Tb, and one example of an output signal from the right laser displacement sensor and an output signal from the left laser displacement sensor when the tablet Tb is in a non-inclined state.

An output signal from the first tablet posture sensor unit 23 varies depending on a distance between a laser beam emission surface and a surface of a tablet Tb. The shorter the distance, the higher a value of an output signal becomes. For example, FIG. 5 (a: a view as viewed from the conveying direction, b: a plan view, c: a view as viewed from the direction orthogonal to the conveying direction (hereinafter, the same goes for FIG. 6 to FIG. 9)) shows a state where a tablet Tb passes through an area below the first tablet posture sensor unit 23 (laser displacement sensors 23*a*, 23*b*) without inclination. When the tablet Tb passes through the area, an output signal out1 from the right laser displacement sensor 23*a* and an output signal out2 from the left laser displacement sensor 23*b* have substantially the same waveform as shown in FIGS. 5(*d*), (*e*). That is, the respective output signals out1, out2 rise when laser spots from the corresponding laser displacement sensors 23*a*, 23*b* fall within a tablet Tb, and levels of the output signals out1, out2 vary corresponding to a shape of the tablet Tb on scan lines of the laser spots and, then, the output signals out1, out2 fall when the laser spots fall outside the tablet Tb. The output signals out1, out2 have rising state periods of widths A1, A2 which correspond to a time during which scanning is performed on a surface of the tablet Tb by the laser spots. A distance L1 from the right laser displacement sensor 23*a* to the surface of the tablet Tb and a distance L2 from the left laser displacement sensor 23*b* to the surface of the tablet Tb are substantially equal to each other (L1=L2: see FIG. 5(*a*)). Accordingly, the level of the output signal out1 from the right laser displacement sensor 23*a* and the level of the output signal out2 from the left laser displacement sensor 23*b* are substantially equal to each other overall (see FIGS. 5(*d*), (*e*)).

Figure 6:
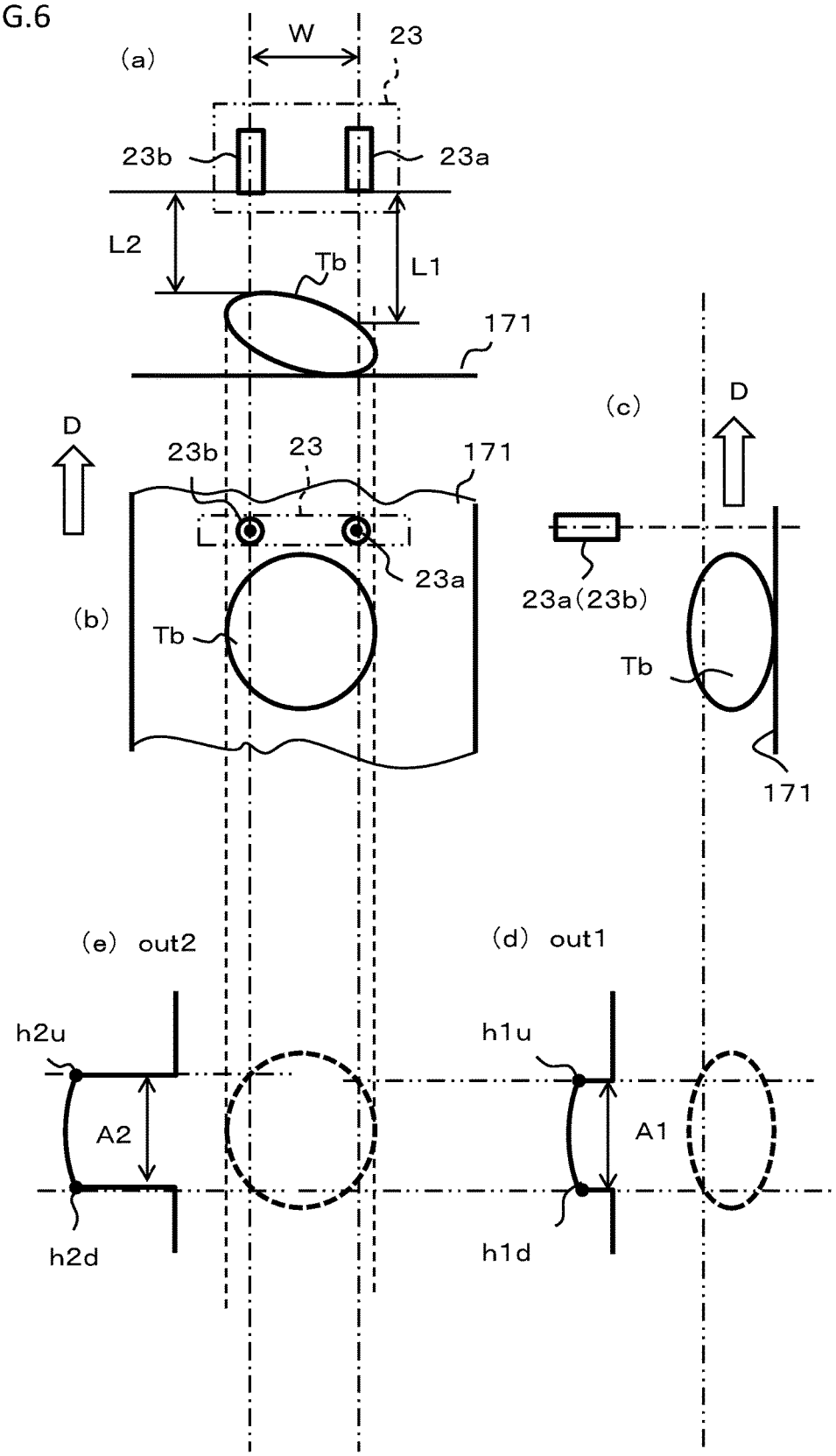
FIG. 6 is a view showing one example of the relationship among the right laser displacement sensor, the left laser displacement sensor and a tablet Tb, and one example of an output signal from the right laser displacement sensor and an output signal from the left laser displacement sensor when the tablet is in an inclined state in the direction orthogonal to the advancing direction D such that the left side of the tablet in the conveying direction D lifts.

For example, assume a case where, as shown in FIGS. 6(*a*), (*b*), (*c*), a tablet Tb passes through the area below the first tablet posture sensor unit 23 in a state where the tablet Tb is inclined in the direction orthogonal to the advancing direction D such that the left side of the tablet Tb in the conveying direction D lifts. In such a case, an output signal out1 from the right laser displacement sensor 23*a* has a waveform shown in FIG. 6(*d*), and an output signal out2 from the left laser displacement sensor 23*b* has a waveform shown in FIG. 6(*e*). That is, in the same manner as the case shown in FIGS. 5(*d*), (*e*), the respective output signals out1, out2 have rising state periods of widths A1, A2 which correspond to a time during which scanning is performed on a surface of the tablet Tb by the laser spots from the corresponding laser displacement sensors 23*a*, 23*b*. A distance L1 from the right laser displacement sensor 23*a* to the surface of the tablet Tb is larger than a distance L2 from the left laser displacement sensor 23*b* to the surface of the tablet Tb (L1>L2: see FIG. 6(*a*)). Accordingly, a level of the output signal out1 from the right laser displacement sensor 23*a* is lower than a level of the output out2 from the left laser displacement sensor 23*b* overall (see FIGS. 6(*d*), (*e*)).

Figure 7:
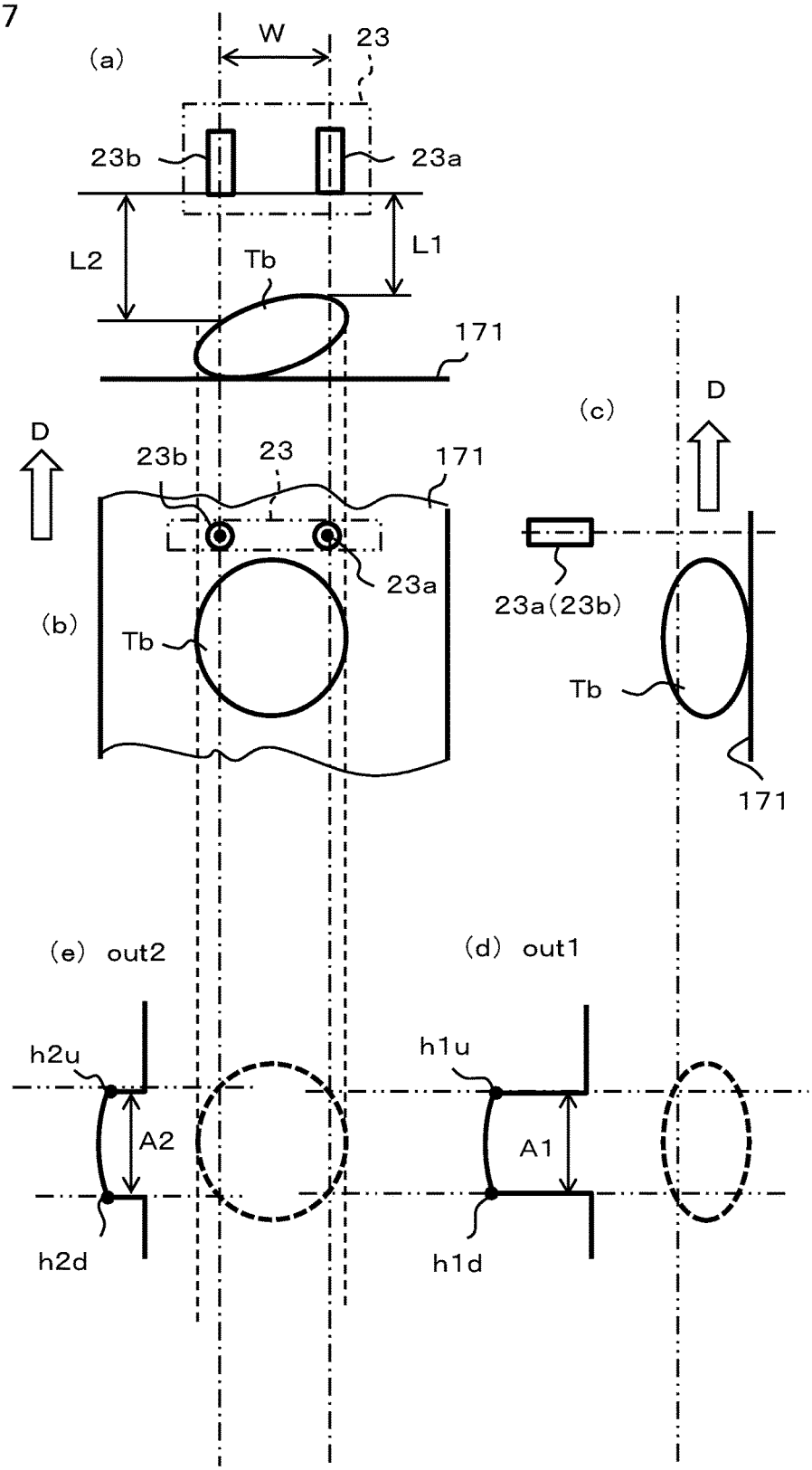
FIG. 7 is a view showing one example of the relationship among the right laser displacement sensor, the left laser displacement sensor and a tablet Tb, and one example of an output signal from the right laser displacement sensor and an output signal from the left laser displacement sensor when the tablet Tb is in an inclined state in the direction orthogonal to the advancing direction D such that the right side of the tablet Tb in the conveying direction D lifts.

For example, assume a case where, as shown in FIGS. 7(*a*), (*b*), (*c*), a tablet Tb passes through the area below the first tablet posture sensor unit 23 in a state where the tablet Tb is inclined in the direction orthogonal to the advancing direction D such that the right side of the tablet Tb in the conveying direction D lifts. In such a case, an output signal out1 from the right laser displacement sensor 23*a* has a waveform shown in FIG. 7(*d*), and an output signal out2 from the left laser displacement sensor 23*b* has a waveform shown in FIG. 7(*e*). That is, in the same manner as the cases respectively shown in FIGS. 5(*d*), (*e*) and FIGS. 6(*d*), (*e*), the respective output signals out1, out2 have rising state periods of widths A1, A2 which correspond to a time during which scanning is performed on a surface of the tablet Tb by laser spots from the corresponding laser displacement sensors 23*a*, 23*b*. A distance L1 from the right laser displacement sensor 23*a* to the surface of the tablet Tb is smaller than a distance L2 from the left laser displacement sensor 23*b* to the surface of the tablet Tb (L1<L2: see FIG. 7(*a*)). Accordingly, a level of the output signal out1 from the right laser displacement sensor 23*a* is higher than a level of the output signal out2 from the left laser displacement sensor 23*b* overall (see FIGS. 7(*d*), (*e*)).

Figure 8:
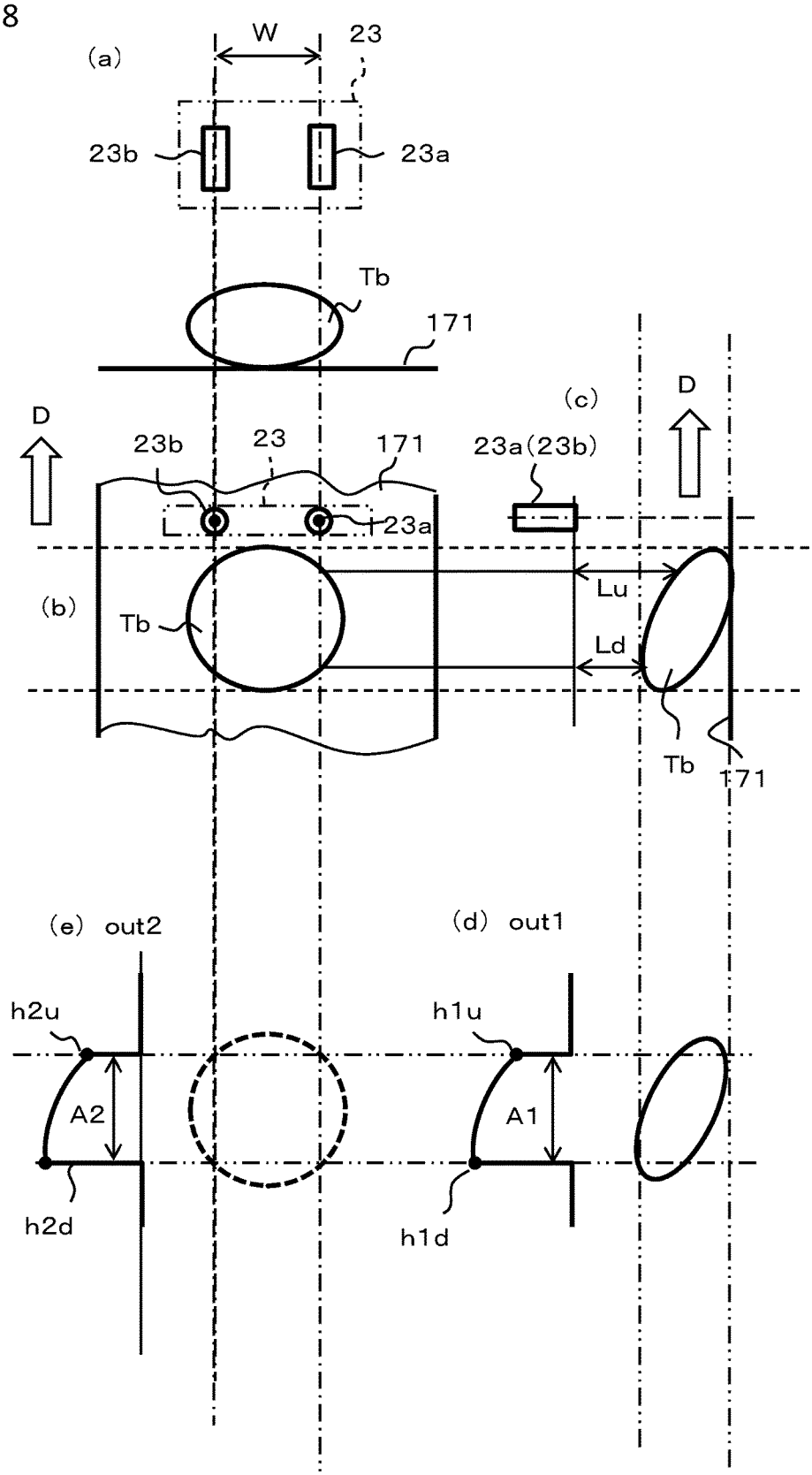
FIG. 8 is a view showing one example of the relationship among the right laser displacement sensor, the left laser displacement sensor and a tablet Tb, and one example of an output signal from the right laser displacement sensor and an output signal from the left laser displacement sensor when the tablet Tb is in an inclined state in the advancing direction D such that the upstream side of the tablet Tb in the conveying direction D lifts.

For example, assume a case where, as shown in FIGS. 8(*a*), (*b*), (*c*), a tablet Tb passes through the area below the first tablet posture sensor unit 23 in a state where the tablet Tb is inclined in the advancing direction D such that the upstream side of the tablet Tb in the conveying direction D lifts. In such a case, an output signal out1 from the right laser displacement sensor 23*a* has a waveform shown in FIG. 8(*d*), and an output signal out2 from the left laser displacement sensor 23*b* has a waveform shown in FIG. 8(*e*). That is, in the same manner as the cases respectively shown in FIGS. 5(*d*), (*e*), FIGS. 6(*d*), (*e*), and FIGS. 7(*d*), (*e*), the respective output signals out1, out2 have rising state periods of widths A1, A2 which correspond to a time during which scanning is performed on a surface of the tablet Tb by the laser spots from the corresponding laser displacement sensors 23*a*, 23*b*. A distance Lu from each of the laser displacement sensors 23*a*, 23*b* to the surface of the tablet Tb when the laser spot falls within the tablet Tb (scanning start point) is larger than a distance Ld from each of the laser displacement sensors 23*a*, 23*b* to the surface of the tablet Tb when the laser spot falls outside the tablet Tb (scanning end point) (Lu>Ld: see FIG. 8(*c*)). Accordingly, levels of the respective output signals out1, out1 which are in a rising state gradually increase corresponding to a shape of the surface of the inclined tablet Tb thus reaching a maximum level value and, then, the respective output signals fall (see FIGS. 8(*d*), (*e*)).

Figure 9:
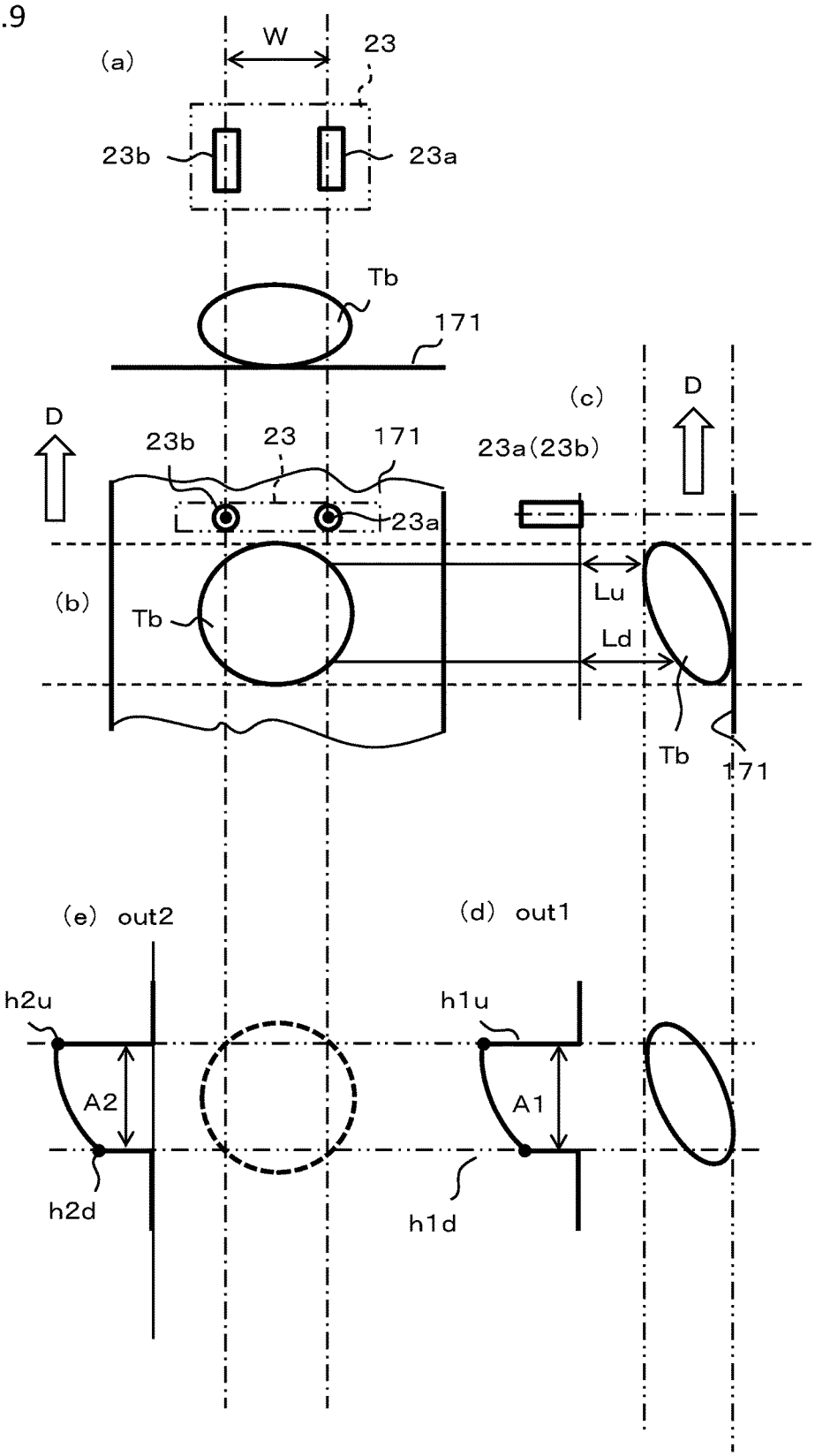
FIG. 9 is a view showing one example of the relationship among the right laser displacement sensor, the left laser displacement sensor and a tablet Tb, and one example of an output signal from the right laser displacement sensor and an output signal from the left laser displacement sensor when the tablet Tb is in an inclined state in the advancing direction D such that the downstream side of the tablet Tb in the conveying direction D lifts.

For example, assume a case where, as shown in FIGS. 9(*a*), (*b*), (*c*), a tablet Tb passes through the area below the first tablet posture sensor unit 23 in a state where the tablet Tb is inclined in the advancing direction D such that the downstream side of the tablet Tb in the conveying direction D lifts. In such a case, an output signal out1 from the right laser displacement sensor 23*a* has a waveform shown in FIG. 9(*d*), and an output signal out2 from the left laser displacement sensor 23*b* has a waveform shown in FIG. 9(*e*). That is, in the same manner as the cases respectively shown in FIGS. 5(*d*), (*e*), FIGS. 6(*d*), (*e*), FIGS. 7(*d*), (*e*), and FIGS. 8(*d*), (*e*), the respective output signals out1, out2 have rising state periods of widths A1, A2 which correspond to a time during which scanning is performed on a surface of the tablet Tb by the laser spots from the corresponding laser displacement sensors 23*a*, 23*b*. A distance Lu from each of the laser displacement sensors 23*a*, 23*b* to the surface of the tablet Tb when the laser spot falls within the tablet Tb (scanning start point) is smaller than a distance Ld from each of the laser displacement sensors 23*a*, 23*b* to the surface of the tablet Tb when the laser spot falls outside the tablet Tb (scanning end point) (Lu<Ld: see FIG. 9(*c*)). Accordingly, levels of the respective output signals out1, out2 in a rising state gradually decrease corresponding to a shape of the surface of the inclined tablet Tb thus reaching a minimum level value and, then, the respective output signals fall (see FIGS. 9(*d*), (*e*)).

As described above, in the cases where a tablet Tb is not inclined (see FIG. 5), where a tablet Tb is inclined in the direction orthogonal to the conveying direction D (see FIG. 6, FIG. 7), and where a tablet Tb is inclined in the conveying direction D (see FIG. 8, FIG. 9), the right laser displacement sensor 23*a* and the left laser displacement sensor 23*b* output signals out1, out2 having different waveforms. Base on such output signals out1, out2, the inclined posture information of the tablet Tb is generated.

To be more specific, laterally inclined posture information indicating an inclination component in the direction orthogonal to the conveying direction D is calculated as a function of a value ((h1*u*−h2*u*)/W) obtained as follows. With respect to a value at a predetermined point which can be obtained from an output signal out1 from the right laser displacement sensor 23*a* (for example, a distance h1*u* at a rising point (see FIG. 5(*d*) to FIG. 9(*d*))) and a value at a corresponding point which can be obtained from an output signal out2 from the left laser displacement sensor 23*b* (for example, a distance h2*u* at the rising point (see FIG. 5(*e*) to FIG. 9(*e*))), a difference (h1*u*−h2*u*) between these values is obtained. The difference is divided by a distance W between the right laser displacement sensor 23*a* and the left laser displacement sensor 23*b*. Then, the Laterally inclined posture information is obtained as $$\text{Laterally inclined posture information}=F_T((h2u-h2u)/W)$$

For example, as shown in FIG. 5, FIG. 8 and FIG. 9, when a tablet Tb is not inclined in the direction orthogonal to the conveying direction D, the distance h1*u* and the distance h2*u* are equal to each other (h1*u*=h2*u*). Accordingly, h1*u*−h2*u* is zero (h1*u*−h2*u*=0) so that the laterally inclined posture information becomes $F_T(0)$. The laterally inclined posture information $F_T(0)$ indicates that the tablet Tb is not inclined in the direction orthogonal to the conveying direction D.

In the output signal out1 from the right laser displacement sensor 23*a* and the output signal out2 from the left laser displacement sensor 23*b*, corresponding predetermined points are set to the rising points of the respective output signals out1, out2. However, the predetermined points are not limited to the rising points of the output signals. The predetermined points may be falling points of the respective output signals out1, out2 or other corresponding points.

Longitudinally inclined posture information indicating an inclination component in the conveying direction D is calculated as a function of a value ((h1*u*−h1*d*)/A1) obtained as follows. A value h1*u* (h2*u*) at a rising point and a value hid (h2*d*) which corresponds to a falling point are obtained from an output signal out1 from the right laser displacement sensor 23*a* or an output signal out2 from the left laser displacement sensor 23*b*, and a difference (h1*u*−h1*d*) between these values is obtained. The difference is divided by a width A1 (A2) from rising to falling of the output signal out1 from the right laser displacement sensor 23*a*. Then, the longitudinally inclined posture information is obtained as $$\text{Longitudinally inclined posture information}=F_L(h1u-h1d)/A1$$

For example, as shown in FIG. 5, FIG. 6, and FIG. 7, when a tablet Tb is not inclined in the conveying direction D, the distance h1*u* and the distance hid are equal to each other (h1*u*=h1*d*). Accordingly, h1*u*−h2*u* is zero (h1*u*−h2*u*=0) so that longitudinally inclined posture information becomes $F_L(0)$. The longitudinally inclined posture information $F_L(0)$ indicates that the tablet Tb is not inclined in the conveying direction D.

As described above, the inclined posture information (the laterally inclined posture information and the longitudinally inclined posture information) is obtained based on the output signal out1 from the right laser displacement sensor 23*a* and the output signal out2 from the left laser displacement sensor 23*b*. Based on such inclined posture information, the print controller 100 (printing data adjuster) adjusts printing data such that the predetermined printing is performed on a tablet Tb as described above.

Figure 10:
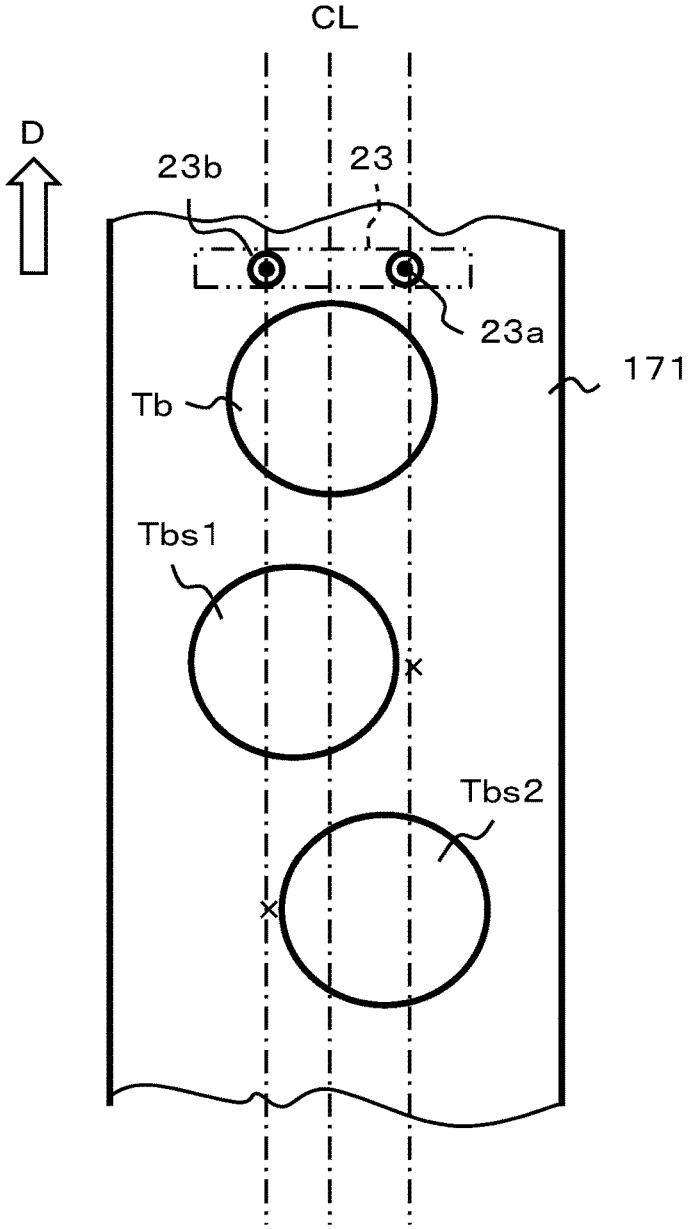
FIG. 10 is a view showing an example of a state where tablets Tb are displaced in the direction orthogonal to the conveying direction on the conveyor belt.

A conveyed tablet Tb may be displaced in the lateral direction on the conveyor belt 171 with respect to the conveying direction D as shown in FIG. 10, for example. In this case, a tablet Tbs1 largely displaced in the left direction is not scanned by a laser spot from the right laser displacement sensor 23*a* so that inclined posture information of the tablet Tbs1 cannot be obtained. Further, a tablet Tbs2 largely displaced in the right direction is not scanned by a laser spot from the left laser displacement sensor 23*b* so that inclined posture information of the tablet Tbs2 cannot be obtained. (In FIG. 10, an area where scanning is not performed is indicated by a mark "x").

Figure 11:
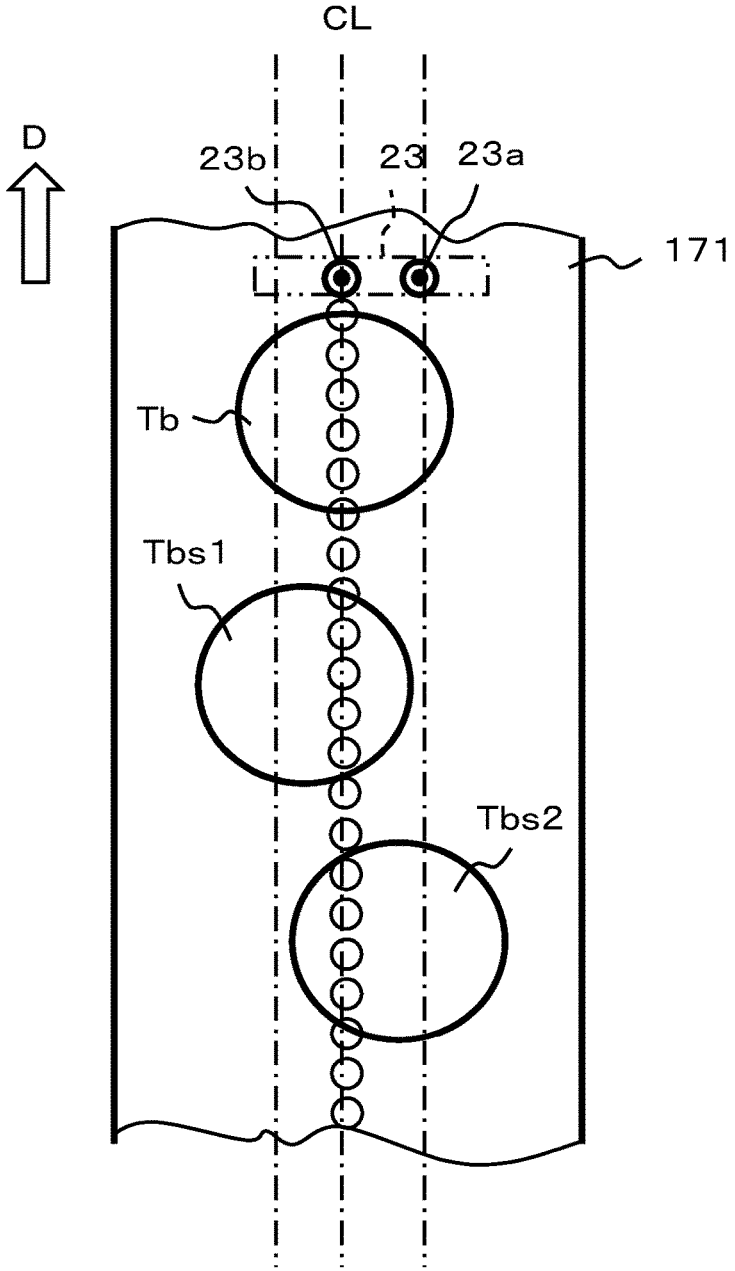
FIG. 11 is a view showing another configuration example of the first tablet posture sensor unit, and the relationship between two laser displacement sensors forming the first tablet sensor unit and tablets displaced in the direction orthogonal to the conveying direction.

To solve such a problem, as shown in FIG. 11, one laser displacement sensor (for example, left laser displacement sensor 23*b*) is preferably disposed so as to opposedly face the line CL (a line along which the through holes 176 are arranged in a row) where center positions of respective tablets Tb to be conveyed are expected to travel.

Figure 12:
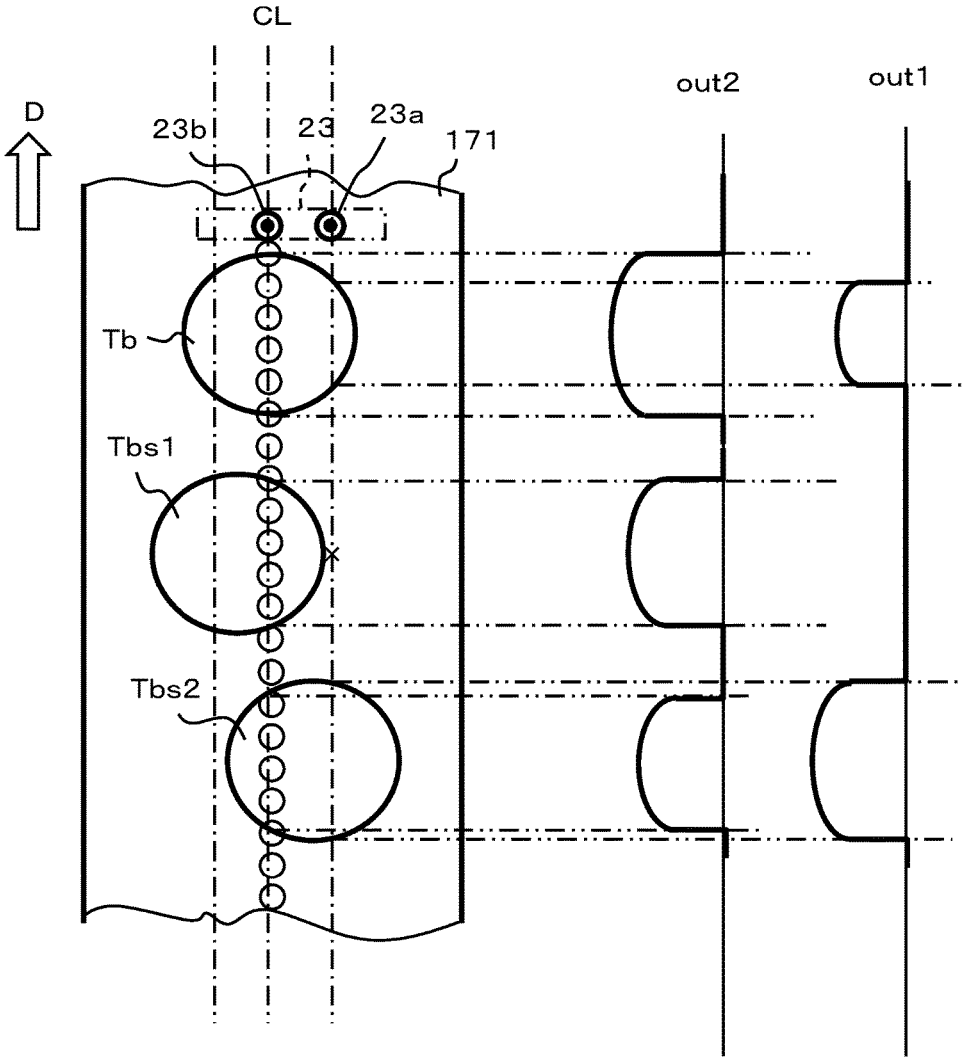
FIG. 12 is a waveform diagram showing one example of output signals from the two laser displacement sensors forming the first tablet posture sensor unit shown in FIG. 11.

By disposing two laser displacement sensors 23*a*, 23*b* as described above, even when a tablet Tb is largely displaced in the lateral direction, it is possible to prevent a laser beam from at least the left laser displacement sensor 23*b* from falling outside the tablet Tb. For example, as shown in FIG. 12, when a tablet Tbs1 largely displaced in the left direction is not scanned by a laser spot from the right laser displacement sensor 23*a* so that a level of an output signal out1 from the right laser displacement sensor 23*a* is zero, and the output signal out1 from the right laser displacement sensor 23*a* is not detected. However, a tablet Tbs2 displaced in the right direction is scanned by a laser spot from the left laser sensor 23*b* so that the output signal out2 is detected. That is, even when a conveyed tablet Tb is conveyed in a largely displaced manner in the lateral direction, the left laser displacement sensor 23*b* is disposed so as to opposedly face the line CL (a line along which the through holes 176 are arranged in a row) where center positions of respective tablets Tb to be conveyed are expected to travel and hence, at least in a case where a tablet Tb is displaced to the right side, detection signals can be obtained from both the right laser displacement sensor 23*a* and the left laser displacement sensor 23*b*. Accordingly, the number of times inclined posture information of a tablet Tb cannot be generated decreases and hence, it is possible to increase a probability that printing can be performed on respective tablets Tb with certainty.

In the above-mentioned example, the first tablet posture sensor unit 23 is formed of two laser displacement sensors. However, the number of laser displacement sensors for forming the first tablet posture sensor unit 23 is not limited to two. For example, the first tablet posture sensor unit 23 may include a center laser displacement sensor (not shown in the drawing) between the right laser displacement sensor 23*a* and the left laser displacement sensor 23*b*.

Figure 13:
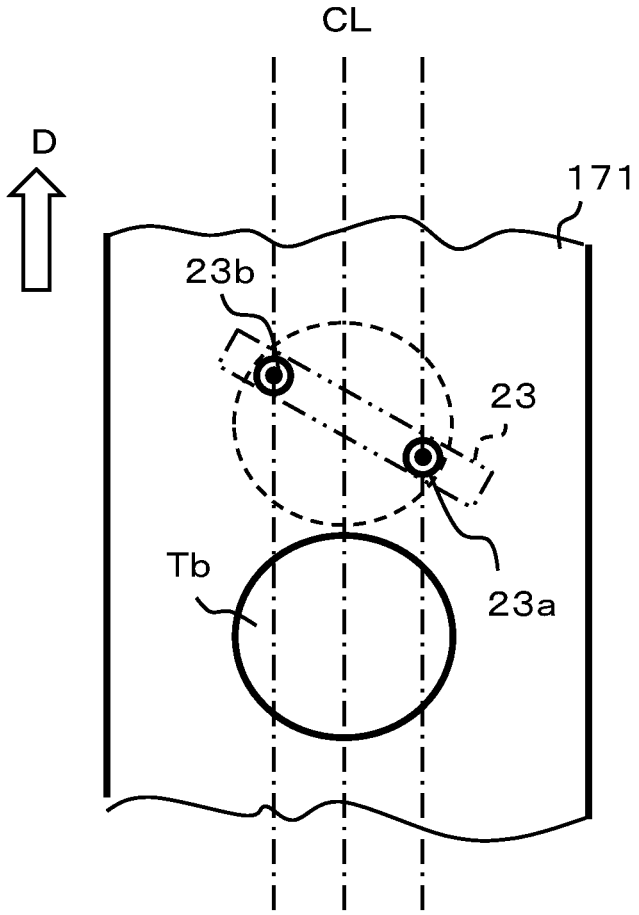
FIG. 13 is a view showing another arrangement example of the two laser displacement sensors forming the first tablet posture sensor unit.

In the above-mentioned example, the right laser displacement sensor 23*a* and the left laser displacement sensor 23*b* forming the first tablet posture sensor unit 23 are arranged in a row in the direction orthogonal to the conveying direction D. However, the arrangement of the right laser displacement sensor 23*a* and the left laser displacement sensor 23*b* is not limited to such an arrangement. For example, as shown in FIG. 13, the right laser displacement sensor 23*a* and the left laser displacement sensor 23*b* may be arranged in a row in the oblique direction with respect to the conveying direction D.

Figure 14A:
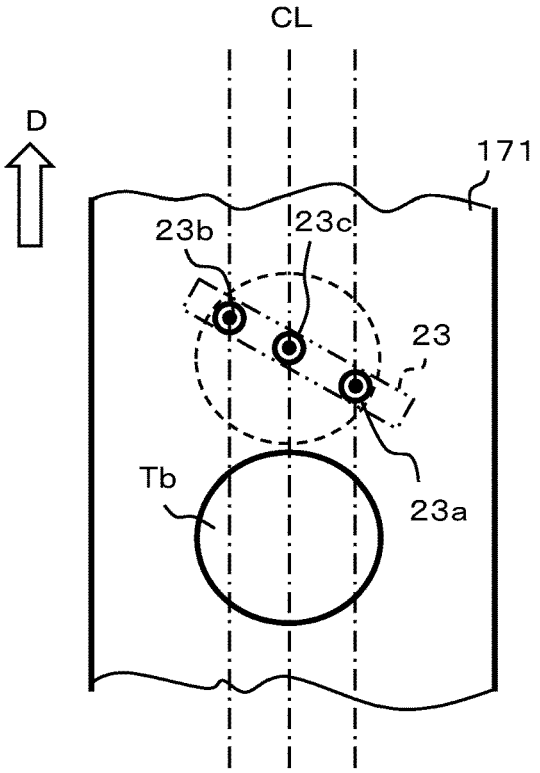
FIG. 14A is a view showing another configuration example of the first tablet posture sensor unit.

In the above-mentioned example, the first tablet posture sensor unit 23 is formed of the two laser displacement sensors 23*a*, 23*b*. However, the components for forming the first tablet posture sensor unit 23 are not limited to such components. For example, as shown in FIG. 14A, the first tablet posture sensor unit 23 may be formed by arranging three laser displacement sensors 23*a*, 23*b*, 23*c* in a row so as to cross the conveying direction D. In this case, more signals based on an inclined posture of a tablet Tb can be obtained from a surface of the tablet Tb, and inclined posture information can be obtained based on these three signals. Accordingly, inclined posture information with higher accuracy can be obtained. Further, even when a tablet Tb is displaced in the lateral direction as described above, the number of times inclined posture information of the tablet Tb cannot be generated further decreases and hence, printing can be performed on respective tablets Tb with certainty.

Figure 14B:
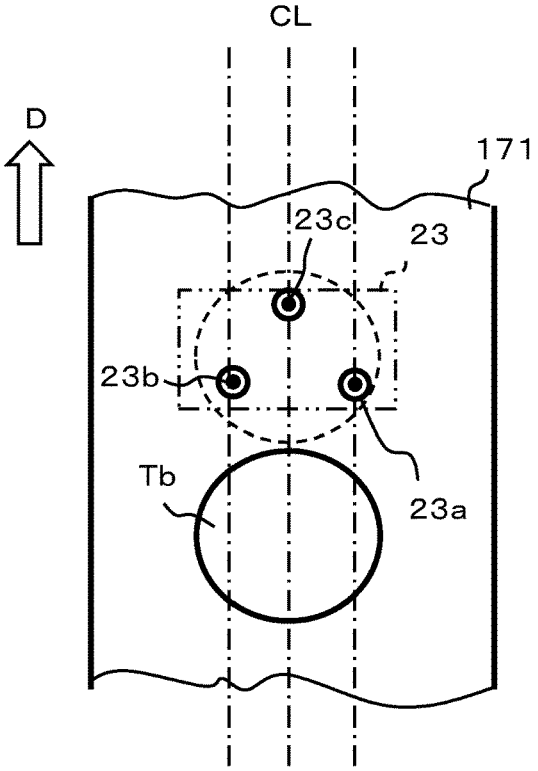
FIG. 14B is a view showing still another configuration example of the first tablet posture sensor unit.

Further, as shown in FIG. 14A, three laser displacement sensors 23*a*, 23*b*, 23*c* are not limited to be arranged on one straight line. For example, as shown in FIG. 14B, the center laser displacement sensor 23*c* may be disposed on the downstream side of two laser displacement sensors 23*a*, 23.

The number of laser displacement sensors forming the first tablet posture sensor unit 23 is not limited to the above-mentioned two or three, and may be four or more. Further, the first tablet posture sensor unit 23 may be formed of a single laser displacement sensor which scans a surface of a conveyed tablet Tb, with a linear laser beam in the direction crossing the conveying direction D (for example, the direction orthogonal to the conveying direction D).

In the above-mentioned example, tablets Tb are fed in two rows onto the conveyor belt 171 (181) (see FIG. 3). However, the number of rows is not limited to two. Tablets Tb may be fed in one row or three or more rows onto the conveyor belt 171 (181). Further, a configuration may be adopted where a plurality of conveyor belts are arranged parallel to each other, and tablets Tb are fed in one row onto each conveyor belt. Particularly, when tablets Tb are conveyed in a plurality of rows, the inkjet head 21 (31), the cameras 24, 25 (34, 35), the dryer 27 (37), and the collection system (28*a*, 28*b*, 40, 38*a*, 38*b*) may be used in common among these tablets Tb in the plurality of rows.

In the example described above, the plurality of laser displacement sensors (23*a*, 23*b*, 23*c*) are used so as to detect an inclined posture of a tablet Tb. However, a component used for detecting the inclined posture of the tablet Tb is not limited to the laser displacement sensors. A camera may be used for detecting the inclined posture of the tablet Tb. In this case, a separated camera may be used in place of the first tablet posture sensor unit 23. Further, the first posture check camera 24 used for detecting a plane posture of a tablet Tb may be used also for detecting an inclined posture of the tablet Tb.

A camera is installed above tablets Tb conveyed by the conveyor belt 171, and the camera takes a picture of the tablet Tb. Based on the image of the picture taken by the camera, the inclined posture information indicating an inclined posture of the tablet Tb can be generated. For example, with respect to a planar image of a tablet Tb which is obtained by taking a picture of the tablet Tb, defocus amounts at respective portions of the planar image are calculated based on contrasting density information. Based on the defocus amounts, the inclined posture information indicating an inclined posture of the tablet Tb can be generated. Further, for example, when the fact is utilized that a planar shape of a tablet Tb varies depending on a degree of inclination of the tablet Tb, the inclined posture information indicating an inclined posture of the tablet Tb can be generated based on a comparison result between a shape of the tablet Tb in a planar image obtained by taking a picture of the tablet Tb and a planar shape (reference planar shape) of the tablet Tb in a non-inclined state. When the fact is utilized that an intensity of reflection light differs depending on an inclination of the tablet Tb between a portion of the tablet Tb close to a camera and a portion of the tablet Tb separated from the camera by a distance, the inclined posture information indicating an inclined posture of a tablet can be also generated based on the contrasting density distribution in a planar image of the tablet Tb which is obtained by taking a picture of the tablet Tb. Further, a camera for taking a picture of a tablet Tb from the above and a camera for taking picture of the tablet Tb from the side are used and, based on a planar image and a side image of the tablet Tb obtained by taking pictures of the tablet Tb using these two cameras, inclined posture information indicating an inclined posture of the tablet Tb can be generated.

Further, with the use of a line sensor where a plurality of CCD elements are linearly arranged, an inclined posture of a tablet Tb can be detected. For example, the line sensor is installed at a predetermined position above the conveyor belt 171 so as to extend in the direction crossing the conveying direction D along which tablets Tb are conveyed (for example, the direction orthogonal to the conveying direction D), and sub scanning (scanning in the direction along which the CCD elements are arranged in a row) and main scanning (scanning in the opposite direction to the conveying direction D) are performed on conveyed tablets Tb. With such operations, a planar image can be obtained. Further, in the same manner as the case of the above-mentioned camera, an inclined posture of the tablet Tb can be detected from the planar image. That is, it is possible to generate inclined posture information.

In the example described above, damage of a tablet Tb is detected and, at the same time, a posture of the tablet Tb is checked by the first posture check camera 24. However, the configuration is not limited to such a configuration. For example, by making the right laser displacement sensor 23*a* and the left laser displacement sensor 23*b* detect the position of a tablet Tb, the first posture check camera 24 may be omitted. In the case where the left laser displacement sensor 23*b* is disposed as shown in FIG. 11, when the output out2 from the left laser displacement sensor 23*b* falls earlier than falling of the output signal obtained in the case where a tablet Tb is conveyed with a reference posture, it can be understood that the conveyed tablet Tb is displaced in the direction orthogonal to the conveying direction. Positional relationship of a tablet Tb is stored in the print controller 100 in advance in combination with a value of an output out1 from the right laser displacement sensor 23*a*, and an actual output value is compared with the values of the outputs out1. With such operations, the position of the tablet Tb can be detected.

Assume the case where the position of a tablet Tb is detected by the first tablet posture sensor unit 23. In such a case, when a tablet inspection device is used in a step performed before to a step where the tablet printing apparatus described in the embodiment is used so as to inspect damage of a tablet Tb in advance, an inspection of damage performed before printing can be omitted. Accordingly, the first posture check camera 24 can be omitted.

Figure 15:
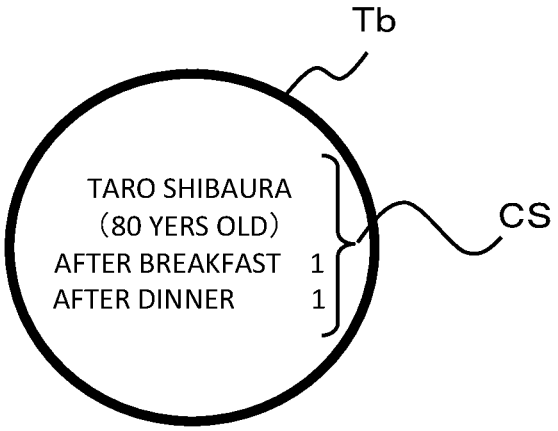
FIG. 15 is a view showing an example of printing performed on a tablet in another embodiment.

A simple tablet printing apparatus based on the present invention may be installed in a pharmacy, for example. In this case, the tablet printing apparatus preferably includes a print information inputting portion. A pharmacist can input print information (printing data) to be printed on a tablet Tb into the print information inputting portion based on content described in a prescription. As information to be inputted in the print information inputting portion, the patient's name taking a tablet Tb, the patient's age, the number of tablets to be taken at one time, the times for the patient to take the tablet (morning, noon, before bed or the like), printing color and the like can be considered. The tablet printing apparatus performs printing on a tablet Tb based on these input information. FIG. 15 shows a sample of a tablet Tb on which rows of letters/symbols CS indicating the patient's name, the patient's age, the times for the patient to take a tablet and the like are printed in this manner.

The embodiment of the present invention and modifications of respective parts are described heretofore. However, the embodiment and the modifications of the respective parts are merely given for the sake of example, and do not intend to limit the scope of the invention. The above-mentioned novel embodiment can be carried out in other various embodiments, and various omissions, replacements, and changes may be made thereto without departing from the gist of the invention.

These embodiments and modifications of the embodiments are also included in the scope and the gist of the invention, and are also included in the invention described in Claims.

REFERENCE SIGNS LIST

11 hopper
12*a* first vibrating feeder
12*b* second vibrating feeder
13 first transfer feeder
14 alignment feeder
16 second transfer feeder

17 first conveyor
171 conveyor belt
172 drive pulley
173 tension pulley
174*a*, 174*b* adjustment pulley
175 suction chamber
176 through hole
18 second conveyor
181 conveyor belt
182 drive pulley
183 tension pulley
184*a*, 184*b* adjustment pulley
185 suction chamber
21 first inkjet head
23 first tablet posture sensor unit
23*a*, 23*b*, 23*c* laser displacement sensor
24 first posture check camera
25 first print check camera
26*a*, 26*b* air injection nozzle
27 first dryer
28*a*, 28*b* collection tray
31 second inkjet head
33 second tablet posture sensor unit
34 second posture check camera
35 second print check camera
36*a*, 36*b* air injection nozzle
37 second dryer
38*a*, 38*b* collection tray
40 storage tray
45 first encoder
46 second encoder
100 print controller

The invention claimed is:

1. A tablet printing apparatus comprising:

an inclined posture detector that detects an inclined posture of a conveyed tablet with respect to a conveying surface;

a printer including an inkjet head equipped with a plurality of nozzles for ejecting an ink droplet, the printer performing printing on the conveyed tablet by ejecting ink to the conveyed tablet from the plurality of nozzles; and a printing data adjuster that adjusts preset printing data in accordance with the inclined posture of the tablet detected by the inclined posture detector such that predetermined printing is performed on the tablet, wherein the printer performs printing on the tablet based on printing data adjusted by the printing data adjuster.

2. The tablet printing apparatus according to claim 1, wherein the inclined posture detector includes:

at least two optical displacement sensors for optically detecting a distance from a surface of the tablet, said at least two optical displacement sensors being arranged in a row in a direction crossing a conveying direction along which the tablet is conveyed; and an inclined posture information generator that generates inclined posture information indicating the inclined posture of the tablet based on outputs from the respective optical displacement sensors.

3. The tablet printing apparatus according to claim 2, wherein said at least two optical displacement sensors include two optical displacement sensors symmetrically disposed with respect to a line where center positions of respective tablets to be conveyed is expected to travel.

4. The tablet printing apparatus according to claim 2, wherein said at least two optical displacement sensors include one optical displacement sensor disposed so as to oppositely face a line where center positions of respective tablets to be conveyed is expected to travel.

5. The tablet printing apparatus according to claim 2, wherein said at least two optical displacement sensors are arranged in a row in a direction orthogonal to the conveying direction along which the tablet is conveyed.

6. The tablet printing apparatus according to claim 5, wherein the inclined posture detector includes three of the optical displacement sensors, and a center optical displacement sensor is disposed on a downstream side of remaining two of the optical displacement sensors in the conveying direction along which the tablet is conveyed.

7. The tablet printing apparatus according to claim 2, wherein the printing data adjuster adjusts printing data so as to increase an ejection amount of ink droplet to a portion of the tablet where a distance from the inkjet head is increased by an inclination of the tablet with respect to a predetermined reference posture of the tablet.

8. A tablet printing method comprising:

an inclined posture detecting step of detecting an inclined posture of a conveyed tablet with respect to a conveying surface;

a printing step of performing printing on the conveyed tablet by ejecting ink to the conveyed tablet from a plurality of nozzles of an inkjet head; and a printing data adjusting step of adjusting preset printing data in accordance with the inclined posture of the tablet detected in the inclined posture detecting step such that predetermined printing is performed on the table, wherein in the printing step, printing is performed based on printing data adjusted in the printing data adjusting step.

9. The tablet printing method according to claim 8, wherein in the printing data adjusting step, printing data is adjusted so as to increase an ejection amount of ink droplet to a portion of the tablet where a distance from the inkjet head is increased by an inclination of the tablet with respect to a predetermined reference posture of the tablet.

* * * * *